US006951837B1

(12) United States Patent
Capeci et al.

(10) Patent No.: US 6,951,837 B1
(45) Date of Patent: Oct. 4, 2005

(54) PROCESS FOR MAKING A GRANULAR DETERGENT COMPOSITION

(75) Inventors: Scott William Capeci, Bend, OH (US); Girish Jagannath, Kobe (JP); Noe Ongcoy Hidalgo, Kobe (JP); Manivannan Kandasamy, Kobe (JP); Takashi Kazuta, Kobe (JP); Yuji Nakamura, Hyogo (JP)

(73) Assignee: The Procter & Gamble Company, Cincinnati, OH (US)

( * ) Notice: Subject to any disclaimer, the term of this patent is extended or adjusted under 35 U.S.C. 154(b) by 243 days.

(21) Appl. No.: 09/979,531

(22) PCT Filed: Jun. 20, 2000

(86) PCT No.: PCT/US00/16917

§ 371 (c)(1),
(2), (4) Date: Feb. 13, 2002

(87) PCT Pub. No.: WO00/78913

PCT Pub. Date: Dec. 28, 2000

Related U.S. Application Data

(60) Provisional application No. 60/140,160, filed on Jun. 21, 1999.

(51) Int. Cl.[7] ..... C11D 11/00

(52) U.S. Cl. ..... 510/444; 510/438; 23/313 R; 23/313 FB

(58) Field of Search ..... 510/444, 438; 23/313 FB, 213 FB, 313 R

(56) References Cited

U.S. PATENT DOCUMENTS

| | | | | | |
|---|---|---|---|---|---|
| 4,411,809 | A | * | 10/1983 | Wixon | 510/324 |
| 4,664,950 | A | * | 5/1987 | Wixon | 510/356 |
| 4,828,721 | A | * | 5/1989 | Bollier et al. | 510/308 |
| 5,332,519 | A | | 7/1994 | Mazzola | 510/351 |
| 5,382,377 | A | * | 1/1995 | Raehse et al. | 510/445 |
| 5,494,599 | A | * | 2/1996 | Goovaerts et al. | 510/443 |
| 5,516,448 | A | | 5/1996 | Capeci et al. | 510/441 |
| 5,646,107 | A | | 7/1997 | Emery et al. | 510/451 |
| 5,668,099 | A | * | 9/1997 | Chapman et al. | 510/444 |
| 5,703,037 | A | * | 12/1997 | Doumen et al. | 510/444 |
| 5,916,867 | A | * | 6/1999 | Aouad et al. | 510/444 |
| 6,069,124 | A | * | 5/2000 | Appel et al. | 510/438 |
| 6,191,095 | B1 | * | 2/2001 | Emery et al. | 510/438 |
| 6,391,844 | B1 | * | 5/2002 | Beimesch et al. | 510/444 |
| 6,492,319 | B1 | * | 12/2002 | Nassano et al. | 510/444 |
| 6,555,514 | B1 | * | 4/2003 | Capeci et al. | 510/444 |

FOREIGN PATENT DOCUMENTS

| | | |
|---|---|---|
| DE | 42 43 704 A1 | 6/1994 |
| DE | 196 22 443 A1 | 12/1997 |
| EP | 0 816 485 A1 | 1/1998 |
| WO | WO 98/24876 A1 | 6/1998 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

A process for detergent composition which has improved solubility or dissolution in laundering solutions, especially in solutions kept at cold temperatures (i.e., less than about 30° C.), is disclosed. The process includes mixing in at least one high-speed, low-speed, or a moderate-speed mixer, and various combinations of such mixers, at least two materials selected from the group consisting of dry agglomerates, wet agglomerates, spray dried granules, and detergent adjunct ingredients to form particles. Optionally a conditioning apparatus may also be used. The granular detergent composition made from this process is aesthetically pleasing to consumers and has improved flowability.

3 Claims, No Drawings

PROCESS FOR MAKING A GRANULAR DETERGENT COMPOSITION

This application is a 371 of PCTUS00/16917 filed Jun. 20, 2000 which claims the benefit of provisional application No. 60/140,160 filed Jun. 21, 1999.

FIELD

The present invention relates to a process for making an improved granular detergent composition which has superior solubility, especially in cold temperature laundering solutions (i.e., less than about 30° C.), excellent flowability, aesthetics or appearance and friability.

BACKGROUND

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case, the undesired result is undissolved detergent residue in the dispensing device.

It has been found that the cause of the aforementioned dissolution problem is associated with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a process by which detergent compositions having improved dissolution without significantly inhibiting formulation flexibility can be produced.

Generally, there are two primary types of processes by which detergent granules or powders can be prepared. The first type of process involves spray-drying an aqueous detergent slurry in a spray-drying tower to produce highly porous detergent granules (e.g., tower process for low density detergent compositions). In the second type of process, the various detergent components are dry mixed after which they are agglomerated with a binder such as a nonionic or anionic surfactant, to produce high density detergent compositions (e.g., agglomeration process for high density detergent compositions). In the above two processes, the important factors which govern the density of the resulting detergent granules are the shape, porosity and particle size distribution of said granules, the density of the various detergent adjunct ingredients, the shape of the various detergent adjunct ingredients, and their respective chemical composition.

More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. The art is also replete with disclosures of processes which entail agglomerating and/or spray-drying detergent compositions from various detergent adjunct ingredients.

Accordingly, there remains a need in the art to have a process for producing a detergent composition which exhibits improved solubility, is more aesthetically pleasing to consumers, has improved flowability and exhibits improved cleaning performance. Furthermore, there remains a need to have a process for producing a detergent composition wherein the density can be achieved by adjusting the process condition. Also, there remains a need for such a process which is more efficient, flexible and economical to facilitate large-scale production of detergents (1) for flexibility in the ultimate density of the final composition, and (2) for flexibility in terms of incorporating several different kinds of detergent ingredients (such as liquid ingredients) into the process. None of the existing art provides all of the advantages and benefits of the present invention.

SUMMARY

The invention meets the needs above by providing a process for making a detergent composition which has improved solubility or dissolution in laundering solutions, especially in solutions kept at cold temperatures (i.e., less than about 30° C.), is aesthetically pleasing to consumers and has improved flowability.

In accordance with one aspect of the invention, a process is provided to form a granular detergent composition with improved solubility, aesthetics and flowability: mixing at least two materials selected from the group consisting of dry agglomerates, wet agglomerates, spray dried granules, and detergent adjunct ingredients in a high-speed, low-speed, or a moderate-speed mixer, and various combinations of such mixers to form particles, wherein the granular detergent composition has at least about 50% by weight of particles having a geometric mean particle diameter of from about 500 microns to about 1500 microns with a geometric standard deviation of from about 1 to about 2.

These and other features, aspects, and advantages of the present invention will become better understood from a reading of the following description, and appended claims.

DETAILED DESCRIPTION

While the specification concludes with claims particularly pointing out and distinctly claiming the invention, it is believed that the present invention will be better understood from the following description.

Accordingly, it is an advantage of the invention to provide a process for making a granular detergent composition which exhibits improved solubility, is more aesthetically pleasing to consumers, has improved flowability and exhibits improved cleaning performance. It is also an advantage to have such a process for making a detergent composition which exhibits such improved dissolution without significantly inhibiting formulation flexibility. Furthermore, it is also an advantage to have such a process wherein the desired density can be achieved by adjusting the process condition, as well as a more efficient, flexible and economical process to facilitate large-scale production of detergents for flexibility in terms of incorporating several different kinds of detergent ingredients into the process.

Definitions

All percentages, ratios, and levels of ingredients referred to herein are based on the actual total amount of the composition, unless otherwise indicated.

All measurements referred to herein are made at 25° C. unless otherwise specified.

All publications, patent applications, and issued patents mentioned herein are hereby incorporated in their entirety by reference. Citation of any reference is not an admission regarding any determination as to its availability as prior art to the claimed invention.

Herein, "comprising" means that other steps and other ingredients which do not affect the end result can be added. This term encompasses the terms "consisting of" and "consisting essentially of."

Herein, "mixtures" is meant to include a simple combination of materials and any compounds that may result from their combination.

Herein, "cold water" means water which has at a temperature of below 30° C.

Herein, "density" or "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

Herein, "ambient" is defined as the temperature and humidity of the environment.

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions. As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook, pp.* 6–11, Meral Dekker 1997.

As used herein, the phrase "builder" means any inorganic material having "builder" performance in the detergency context, and specifically, organic or inorganic material capable of removing water hardness from washing solutions.

As used herein, the phrase "mean residence time" refers to the following definition:

mean residence time (hr)=mass (kg)/flow throughput (kg/hr).

Process

The present invention is directed to a process which produces a granular detergent composition having at least about 50% by weight of particles having a geometric mean particle diameter of from about 500 microns to about 1500 microns with a geometric standard deviation of from about 1 to about 2.

The present invention is directed towards a process for making a granular detergent composition comprising the step of mixing at least two materials selected from the group consisting of dry agglomerates, wet agglomerates, spray dried granules, and detergent adjunct ingredients to form particles, wherein the granular detergent composition comprises at least about 50% by weight of particles having a geometric mean particle diameter of from about 500 microns to about 1500 microns with a geometric standard deviation of from about 1 to about 2.

At least two materials selected from the following group are added to at least one mixer: dry agglomerates, wet agglomerates, spray dried granules, and detergent adjunct ingredients. Optionally, for processes in which a conditioning apparatus is used, any recycled fines generated could also be added to the mixer.

Wet agglomerates include those particles that are manufactured via a granulation type process wherein detergent adjunct ingredients such as described below are admixed with a liquid binder material such as surfactant or a precursor thereof in at least one mixer to form granules of detergent materials. These particles are known as "wet agglomerates" until dried and as "dry agglomerates" upon exiting a drying stage, and optionally other conditioning stages such as sizing, grinding and cooling. Binders include but are not limited to water, anionic surfactants and their precursors, nonionic surfactants, cationic surfactants, polyethylene glycol, polyvinyl pyrrolidone, polyacrylates, citric acid, and mixtures thereof.

Spray dried granules include those particles which are manufactured via a conventional spray-drying technique wherein a slurry of detergent materials is prepared and sprayed downward into an upwardly flowing stream of gas to dry the particles. A dry, free flowing material is produced from the process. For example, the slurry is passed to a tower where the slurry is sprayed into a stream of air at temperatures ranging from about 175° C. to about 450° C. to dry the detergent slurry and form detergent particles. Typically, resultant densities of these particles range from about 200 to about 650 g/l.

Detergent adjunct ingredients include but are not limited to, carbonates, phosphates, sulfates, zeolites, or the like. A list of detergent components which can be used as a detergent adjunct ingredient is described in detail below. Of course other conventionally known ingredients may be included as well.

In one embodiment the mixer contains two materials selected from the group consisting of dry agglomerates, wet agglomerates, spray dried granules, and detergent adjunct ingredients, at a ratio ranging from about 5:95 to about 95:5, more preferably at a ratio ranging from about 10:90 to about 90:10, and even more preferably from about 30:70 to about 70:30.

At least two types of materials selected from the group are fed into at least one mixer for agglomeration. In one embodiment of the invention, the at least two types of materials can be fed into at least one pre-mixer (e.g. a conventional screw extruder, including a twin-screw extruder or other similar mixer) prior to agglomeration in at least one mixer, after which the mixed materials are fed into the initial mixer as described herein.

To achieve the desired geometric mean particle diameter for at least about 50% by weight of the particles in the granular detergent composition, the agglomeration step can be carried initially in at least one high-speed mixer, a moderate-speed mixer, a low-speed mixer, and combinations of mixers thereof. Furthermore, in one embodiment the same type of mixer can be used in a series, or in any combination with the other types of mixers, which may also be in a series. The process can be batch or continuous. Alternatively, two or more mixers can be used in series and/or in parallel, for example to accommodate thoroughput.

For example, one embodiment of the process of the present invention may include mixing at least two materials from the group in at least one high-speed mixer, followed by at least one moderate-speed mixer, with optionally a conditioning step in a fluid bed granulator. In another example, mixing may take place in at least one high-speed mixer, followed by at least one moderate-speed mixer, followed by at least one high-speed mixer, followed by a conditioning step in at least one conditioning apparatus, such as a fluid bed granulator. In yet another example, at least two materials selected from the group initially mixed in a moderate-speed mixer, the mixture then fed to a high-speed mixer, and then conditioned in a fluid bed granulator. Alternatively, the same mixture is mixed in a high-speed mixer after the initial mixing in a moderate-speed mixer, before being conditioned. These examples are only a few of the possible variations of mixers, pre-mixers, and/or conditioning apparatus of the process of the present invention. Detailed examples are also disclosed below.

Residence times of the mixtures will vary depending on the type of mixer and the operating parameters. For a preferred high-speed mixer, the mean residence time is from about 0.1 to 60 seconds, more preferably from about 0.1 to about 30 seconds, even more preferably 0.1 to about 15 seconds. Other preferred conditions of the high-speed mixer include from about 3 to 90 m/s of tip speed, and more preferably from about 10 to 70 m/s of tip speed, and from about 0.005 W/kg to 100 W/kg of power draw, more preferably from about 0.05 W/kg to 80 W/kg of power draw. Preferably, if choppers are used, choppers can be used inside the mixer to break up undesirable oversized particles at an rpm of from about 0 to 5000 rpm, more preferably from about 100 to 3000 rpm. Preferably, the wall temperature is from ambient to about 80° C. and the spacing between the mixer elements and the wall is from about 0.1 cm to 25 cm. Examples of a high-speed mixer having a mean residence time of from about 0.1 to about 60 seconds are Lodige Recycler CB 30™, by Lodige Company, or mixers made by Drais, Schugi, or a similar brand mixer.

For a preferred moderate-speed mixer, the mean residence time is from about 30 to 1800 seconds, more preferably from about 30 to about 1200 seconds, more preferably from about 30 to about 600 seconds. Other preferred conditions of the moderate-speed mixer include from about 0.1 to 30 ml/s of tip speed, and more preferably from about 1 to 25 m/s of tip speed, and from about 5 W/kg to 1000 W/kg of power draw, more preferably from about 20 W/kg to 500 W/kg of power draw. Preferably, if choppers are used, choppers can be used inside the mixer to break up undesirable oversized particles at an rpm of from about 0 to 5000 rpm, more preferably from about 100 to 4000 rpm. Preferably, the wall temperature is from about −20° C. to about 80° C. and the spacing between the mixer elements and the wall is from about 0.1 cm to 25 cm. Examples of a moderate-speed mixer having a mean residence time of from about 30 to about 1800 seconds are Lodige Recycler KM "Ploughshare" 300™ and 600™, by Lodige Company, the Drais K-T 160™ mixer, or mixers made by Fukae. The Lodige KM "Ploughshare" 600™ moderate-speed mixer is a particularly preferred mixer, which comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. In a preferred mixer, the grinding or pulverizing is accomplished by cutters, generally smaller in size that the rotating shaft, which preferably operate at about 3600 rpm.

For a preferred low-speed mixer, the mean residence time is from about 30 seconds to about 1800 seconds, more preferably from about 30 seconds to about 1200 seconds, and even more preferably from about 30 seconds to about 600 seconds. The tip speed is preferably from about 0.1 ml/s to about 10 m/s, more preferably from about 0.2 m/s to about 7 m/s, and even more preferably from about 0.2 m/s to about 3.5 m/s. Examples of preferred low-speed mixers include rotating bowl agglomerators, drum agglomerators, pan agglomerators, fluid bed granulators, and extruders. An example of an extruder is a multiple-screw extruder by Werner-Pfliedder (Germany).

Fluid bed granulators are particularly preferred. Typical fluid bed granulators are operated at a superficial air velocity of from about 0.1 to 4 ml/s, either under positive or negative pressure. Inlet air temperatures generally range from −10° C. or 5° C. up to 250° C. However, inlet air temperatures are generally below 150° C., or even below 100° C. or 80° C. Other conditions include (i) from about 30 seconds to about 20 minutes of mean residence time, (ii) from about 100 to about 600 mm of depth of unfluidized bed, (iii) a droplet spray size of less than 2 times the particle size, preferably not more than about 100 microns, more preferably less than about 50 microns, (iv) from about 150 to about 1600 mm of spray height from the fluid bed plate, (v) from about 0.1 to about 4.0 m/s of fluidizing velocity and (vi) from about 12° C. to about 200° C. of bed temperature, more preferably from about 12° C. to about 150° C., even more preferably from about 12° C. to about 100° C. Other operating conditions for the fluidized bed granulator may be for example as described in WO98/58046. One of ordinary skill in the art will recognize that the conditions in the fluid bed may vary depending on a number of factors.

Optionally, there is a conditioning step. The conditioning step can be at any point in the process. For example, the conditioning step can follow mixing in the initial mixer, or the pre-mixer. If there is a series of mixers and/or combinations of mixers, the conditioning step can fall between two mixers, as well as also following the last mixer in the series. Such step is useful for many benefits, including improving the flow properties of the particles. Conditioning the particles include drying, cooling, coating, grinding, and sieving the particle. This conditioning step can be conducted in any piece of equipment known in the art such as a fluid bed dryer, air lift, fluid bed cooler, fluid bed granulator, bulk heat exchangers, grinder, and siever, or combinations of conditioning apparatus, and including series of conditioning apparatus.

Examples of a fluid bed dryer, fluid bed cooler, and fluid bed granulator's characteristics, include fixed or vibrating; rectangular bed or round bed; and straight or serpentine apparatus. Some apparatus have multiple internal "stages" or "zones", which are discrete areas within the apparatus. Process conditions for these apparatus could be different or similar to the other stages in the apparatus. Manufactures of such conditioning apparatus include Wurster AG, Niro, Bepex, Spray Systems and Glatt. By way of example, apparatus such as a fluid bed or fluidized bed cooler/dryer/granulator, including combinations thereof, can be used for drying while an airlift can be used for cooling should it be necessary. The air lift can also be used to force out the "fine" particles so that they can be recycled. Both air and gas can be used to dry and/or cool.

A fluid bed granulator is especially preferred as an apparatus for the conditioning step. The preferred operating conditions of the fluid bed granulator is described in detail above, and such conditions are also preferred in the conditioning step.

Examples of apparatus (including the fluid bed granulator) that can be used for coating the particles include Wurster Fluid Bed manufactured by Wurster AG (Germany), Glatt Fluid Bed manufactured by Glatt AG (Germany), Niro Fluid Bed manufactured by Niro Aeromatic. Examples of apparatus that can be used for grinding the particles include the Two-cage disintegrator by Stedman Foundry and Machine Co. (USA), Hammer crusher by Jeffrey Mfg. Co. (USA). Examples of sieves include Grizzly screens made by W. S. Tyler Company (USA), mechanically vibrated Screens made by Mogensen Co. (USA), Gyratory Screens made by Allis-Chalmers Manufacturing Co. (USA).

In another optional process, the process of the present invention may additionally include a finishing step as part of the conditioning step including but not limited to, admix and/or spray-on of additional ingredients such as enzymes, bleach, perfumes, etc., or a packaging step. Another optional step is that the particles may be further processed by adding a coating agent to improve the particle color, increase the particle "whiteness", or improve the particle flowability after the particles exit the mixer or the conditioning apparatus to obtain the granular detergent composition produced by the present invention. Yet another optional processing step includes continuously adding a coating agent such as zeolites and fumed silica to the mixer to facilitate free flowability of the resulting detergent particles and to prevent over granulation.

The resultant composition after mixing at least two materials from the group form a granular detergent composition having at least about 50% by weight of particles having a geometric mean particle diameter of from about 500 microns to about 1500 microns with a geometric standard deviation of from about 1 to about 2.

When a conditioning step is used in the process and fines or "fine" particles are generated as a result of using a conditioning apparatus, it is preferred that the fines are recycled back into the process. There are many alternatives as to how the fines are recycled back for further agglomeration to the desired particle size. The fines can be recycled back to any one or several mixers. Fines or "fine" particles are defined as particles that have a geometric mean particle diameter that is less than about 1.65 standard deviations below the chosen geometric mean particle diameter of the granular detergent composition at a given geometric standard deviation.

Physical Properties

The granular detergent composition made by the process of the present invention achieves the desired benefits of solubility, improved aesthetics and flowability via optimal selection of the geometric mean particle diameter of certain levels of particles in the composition. By "improved aesthetics", it is meant that the consumer views a granular detergent product which has a more uniform appearance of particles as opposed to past granular detergent products which contained particles of varying size and composition. To that end, at least about 50%, more preferably at least about 75%, even more preferably at least about 90%, and most preferably at least about 95%, by weight of the total particles in the detergent product, have the selected mean particle size diameter. In this way, a substantial portion of the granular detergent product will have the uniform size so as to provide the aesthetic appearance desired by consumers.

Preferably, the geometric mean particle diameter of the particles is from about 500 microns to about 1500 microns, more preferably from about 600 microns to about 1200 microns, and most preferably from about 600 microns to about 1000 microns. The particle size distribution is defined by a relative tight geometric standard deviation or "span" so as not to have too many particles outside of the target size. Accordingly, the geometric standard deviation is preferably is from about 1 to about 2, more preferably is from about 1.0 to about 1.7, even more preferably is from about 1.0 to about 1.4, and most preferably is from about 1.0 to about 1.2. The bulk density of the particles is preferably in the range of from about 400 g/l to about 850 g/l, more preferably from about 550 g/l to about 800 g/l, and even more preferably from about 600 to about 750 g/l.

While not intending to be bound by theory, it is believed that solubility is enhanced as a result of the particles in the detergent composition being more of the same size. Specifically, as a result of the particles being more uniform in size, the actual "contact points" among the particles in the detergent composition is reduced which, in turn, reduces the "bridging effect" commonly associated with the "lump-gel" dissolution difficulties of granular detergent compositions. Previous granular detergent compositions contained particles of varying sizes which leads to more contact points among the particles. For example, a large particle could have many smaller particles in contact with it rendering the particle site ripe for lump-gel formation. The level and uniform size of the particles in the granular detergent composition of the present invention avoids such problems. Furthermore, it is believed that the particles have better chemical homogeneity, e.g. the particles are more uniform in quality.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will contain from about 1% to about 50% by weight of a detersive surfactant and from about 1% to about 75% by weight of a detergent builder.

A particularly important attribute of detergent powders is color. Color is usually measured on a Hunter Colorimeter and reported as three parameters "L", "a" and "b". Of particular relevance to the powdered detergent consumer is the whiteness of the powder determined by the equation L-3b. In general, whiteness values below about 60% are considered poor. Whiteness can be improved by a number of means known to those of ordinary skill in the art. For example, coating granules with Titanium Dioxide.

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. And the combination of the two parameters as defined by the product of the parameters is important as well (i.e. both must be controlled to get a product with good appearance). Preferably, the granular detergent compositions produced by the process of the present invention have circularities less than about 50, preferably less than about 30, more preferably less than about 23, most preferably less than about 18. Also preferred are granular detergent compositions with aspect ratios less than about 2, preferably less than about 1.5, more preferably less than about 1.3 most preferably less than about 1.2.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

Detergent Components

The detergent components described herein may be used as a detergent adjunct ingredient in the process of the invention.

The surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1-5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Hydrophobic secondary alkyl sulfates are also preferred. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Harman, issued Nov. 20, 1984, both of which are incorporated herein by reference. Chelating agents are also described in U.S. Pat. No. 4,663,071, Bush et al., from Column 17, line 54 through Columm 18, line 68, incorporated a herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

EXAMPLES

The following examples are presented for illustrative purposes only and are not to be construed as limiting the scope of the appended claims in any way.

These Examples illustrate a process according to this invention which produces uniform free flowing, crisp, high density detergent particles of the desired size.

Example 1

The following is an example for obtaining dust-free high density granules with narrower particle size distribution, improved flowability and better solubility.

In Example 1 and all the examples that follow, the spray dried granule is comprised of 11% surfactant, 74% inorganic salts, 5% polyacrylate polymer, 5% soap, and 5% moisture. The dry agglomerate composition is comprised of 30% surfactant, 62% inorganic salts, 4% sodium aluminosilicate, and 4% moisture.

Step 1

360 kg/hr of a spray-dried granule (particle size of 400 microns, bulk density of 400 $\mu$l) and 360 kgs/her of a dry agglomerate (particle size of 450 microns, bulk density of 780 g/l) is introduced into a moderate-speed KM-6001>Lodige Mixer with 8 serrated ploughs and 4 "christmas-tree" choppers mounted perpendicular to the ploughs along the length of the mixer. The mixer is divided into four zones. The gap between the ploughs and the wall of the mixer is about 3 cm. The wall temperature is maintained at 30° C.

Step 2

105–115 kg/hr of aqueous linear alkyl benzene sulphonate paste (C11–C18, 60% active) is dispersed by the first chopper into the moderate-speed mixer and 70 kg/hr of crystalline sodium aluminosilicate is added in the last zone of the mixer. The surfactant paste is fed at 50° C. and the powders are fed at room temperature. The condition of the mixer is as follows:

| | |
|---|---|
| Mean residence time: | 7.5–10 minutes |
| Tip Speed: | 2–3 m/s |
| Power Draw: | 20–500 W/kg |
| Chopper RPM: | 3600 |

Step 3

The product from the moderate-speed is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%. Sizing takes place in a Mogensen Sizer with a top sieve of 1180–1900 micron spacing and a bottom sieve of 300–450 microns spacing. The resulting granules have a bulk density of 800 g/l, a mean particle size of 600 microns, less than 3% of the granules are below 300 microns and less than 3% of the granules are above 1180 microns.

Example 2

Step 1

800 grams of a spray-dried granule (particle size of 400 microns, bulk density of 400 g/l) is premixed for 2 minutes in a Processal™ Tilt-a-plow bench-scale Mixer with a total volume of 4 liters. This mixer is equipped with standard ploughs and one tulip-shaped chopper bottom-mounted in the centre of the mixer.

Step 2

200 grams of aqueous linear alkyl benzene sulphonate paste (C11–C18, 60% active) is injected into the mixer and dispersed with the action of the chopper blades on the powders over a period of 5 minutes. The paste is at 50° C. and the powders are at room temperature.

Step 3

After the paste is added, mixing is continued for 2.5 minutes and then 100 grams of crystalline sodium aluminosilicate is added into the mixer.

Mixer Operating Conditions are as follows:

| | |
|---|---|
| Total batch time: | 15 minutes |
| Tip Speed: | 0.5–1 m/s |
| Chopper RPM: | 3600 |

After mixing further for 3 minutes, the contents are fed into a fluidized bed for drying. The inlet air temperature is 105° C., air velocity is 0.6 m/s and drying time is 5 minutes. Then the dried granules are sieved using a Ro-tap sieve shaker with a top sieve of 1180 microns and a bottom sieve of 300 microns.

The resulting granules have a bulk density of 650–680 g/l, a mean particle size of 600 microns, less than 3% of the granules are below 300 microns and less than 3% of the granules are above 80 microns.

Example 3

Step 1

360 kg/hr of a spray-dried granule (particle size of 400 microns, bulk density of 400 g/l) and 360 kg/hr of a dry agglomerate (particle size of 450 microns, bulk density of 780 g/l) is introduced into a Schugi Mixer. 40 kg/hr of aqueous linear alkyl benzene sulphonate paste (C11–18, 30% active) is sprayed on the powders using a SU 26 two-fluid nozzle (air pressure: 1–5 kg/cm$^2$, liquid pressure: 2–3 kg/cm$^2$). The liquid is sprayed on at 50° C. and the powders are at room temperature. The operating conditions of the high-speed Schugi Mixer are as follows:

| | |
|---|---|
| Tip Speed: | 24 m/s |
| Mean residence Time: | 0.1–1 second |
| Power Draw: | 1–5 kW/kg |

Step 2

The output from the high speed mixer is fed into a moderate speed KM-600™ Mixer and 60 kg/hr of aqueous linear alkyl benzene sulphonate paste (C11–C18, 60% active) is dispersed by the first chopper into the moderate speed mixer and 70 kg/hr of crystalline sodium aluminosilicate is added in the last zone of the mixer. The surfactant paste is fed at 50° C. The condition of the moderate-speed mixer is as follows:

| | |
|---|---|
| Mean residence time: | 2–3 minutes |
| Tip Speed: | 2–3 m/s |
| Power Draw: | 20–500 W/kg |
| Chopper RPM: | 3600 |

Step 3

The product from the moderate-speed mixer is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%. Sizing takes place in a Mogensen Sizer with a top sieve of 1180–1900 micron spacing and a bottom sieve of 300–450 microns spacing.

The resulting granules have a bulk density of 550–600 $\mu$l, a mean particle size of 600 microns, less than 3% of the granules are below 300 microns and less than 3% of the granules are above 1180 microns.

Optionally, the undersize generated in the process can be recycled via the Schugi at 20% level and the ground overs via the fluid bed at 20% level.

Example 4

Step 1

360 kg/hr of a spray dried granule (particle size of 400 microns, bulk density of 400 $\mu$l) and 360 kg/her of a dry agglomerate (particle size of 450 microns, bulk density of 780 $\mu$l) is introduced into a high-speed Schugi Mixer. 40 kg/hr of aqueous linear alkyl benzene sulphonate paste (C11–C18, 30% active) is sprayed on the powders using a SU 26 two-fluid nozzle (air pressure: 1–5 kg/cm$^2$, liquid pressure: 2–3 kg/cm$^2$). The liquid is sprayed on at 50° C. and the powders are at room temperature. The operating conditions of the high-speed Schugi Mixer are as follows:

| | |
|---|---|
| Tip Speed: | 24 m/s |
| Mean residence Time: | 0.1–1 second |
| Power Draw: | 1–5 kW/kg |

Step 2

The output from the Schugi is fed into a moderate speed KM-600™ Mixer and 40 kg/hr of aqueous linear alkyl benzene sulphonate paste (C11–C18, 60% active) is dispersed by the first chopper into the moderate speed mixer and 50 kg/hr of crystalline sodium aluminosilicate is added in the last zone of the mixer. The surfactant paste is fed at 50° C. The condition of the moderate-speed mixer is as follows:

| | |
|---|---|
| Mean residence time: | 2–3 minutes |
| Tip Speed: | 2–3 m/s |
| Power Draw: | 20–500 W/kg |
| Chopper RPM: | 3600 |

Step 3

The product from the moderate speed is fed into a second high-speed Schugi Mixer. 20 kg/hr of aqueous polyethylene glycol solution (mol.wt.:4000, 40% active) is sprayed on the powders using a SU 26 two-fluid nozzle (air pressure: 1–5 kg/cm$^2$, liquid pressure: 2–3 kg/cm$^2$). The liquid is sprayed on at 50° C. The operating conditions of the Schugi Mixer are as follows:

| | |
|---|---|
| Tip Speed: | 24 m/s |
| Mean residence Time: | 0.1–1 second |
| Power Draw: | 1–5 kW/kg |

Step 4

The output from the Schugi is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%. Sizing takes place in a Mogensen Sizer with a top sieve of 1180–1900 micron spacing and a bottom sieve of 300–450 microns spacing.

The resulting granules have a bulk density of 500–550 g/l, a mean particle size of 600 microns, less than 3% of the granules are below 300 microns and less than 3% of the granules are above 1180 microns.

Example 5

Step 1

360 kg/hr of a spray-dried granule (particle size of 400 microns, bulk density of 400 g/l) and 360 kgs/her of a dry agglomerate particle size of 450 microns, bulk density of 780 g/l) is introduced into a KM-600™ Mixer. 60 kg/hr of aqueous linear alkyl benzene sulphonate paste (C11–C18, 60% active) is dispersed by the first chopper into the moderate-speed and 50 kg/hr of crystalline sodium aluminosilicate is added in the last zone of the mixer. The surfactant paste is fed at 50° C. and the powders are at room temperature. The condition of the KM-600™ mixer is as follows:

| | |
|---|---|
| Mean residence time: | 2–3 minutes |
| Tip Speed: | 2–3 m/s |
| Power Draw: | 20–500 W/kg |
| Chopper RPM: | 3600 |

Step 2

The output from the KM-600™ Mixer is fed into a high-speed Schugi mixer and 40 kg/h of aqueous polyethylene glycol solution (mol.wt.:4000, 40% active) is sprayed on the powders using a SU 26 two-fluid nozzle (air pressure: 1–5 kg/cm$^2$, liquid pressure: 2–3 kg/cm$^2$). The liquid is sprayed on at 50° C. The operating conditions of the Schugi Mixer are as follows:

| | |
|---|---|
| Tip Speed: | 24 m/s |
| Mean residence Time: | 0.1–1 second |
| Power Draw: | 1–5 kW/kg |

Step 3

The product from the Schugi mixer is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%. Sizing takes place in a Mogensen Sizer with a top sieve of 1180–1900 micron spacing and a bottom sieve of 300–450 microns spacing.

The resulting granules have a bulk density of 550–600 g/, a mean particle size of 600 microns, less than 3% of the granules are below 300 microns and less than 3% of the granules are above 1180 microns.

Example 6

Step 1

360 kgs/her of a dry agglomerate (particle size of 450 microns, bulk density of 780 gA) is introduced into a high-speed Schugi Mixer. 40 kg/hr of aqueous linear alkyl benzene sulphonate paste (C11–18, 30% active) is sprayed on the powders using a SU 26 two-fluid nozzle (air pressure: 1–5 kg/cm$^2$, liquid pressure: 2–3 kg/cm$^2$). The liquid is sprayed on at 50° C. and the powder is at room temperature. The operating conditions of the Schugi Mixer are as follows:

| | |
|---|---|
| Tip Speed: | 24 m/s |
| Mean residence Time: | 0.1–1 second |
| Power Draw: | 1–5 kW/kg |

Step 2

The output from the Schugi is fed into a moderate speed KM-600™ Mixer. 360 kg/hr of a spray-dried granule (particle size of 400 microns, bulk density of 400 g/l) is fed into the mixer and 60 kg/hr of aqueous linear alkyl benzene sulphonate paste (C11–C18, 60% active) is dispersed by the first chopper into the moderate-speed mixer and 70 kg/hr of crystalline sodium aluminosilicate is added in the last zone of the mixer. The surfactant paste is fed at 50° C. and the powder is at room temperature. The condition of the KM-600™ mixer is as follows:

| | |
|---|---|
| Mean residence time: | 2–3 minutes |
| Tip Speed: | 2–3 m/s |
| Power Draw: | 20–500 W/kg |
| Chopper RPM: | 3600 |

Step 3

The product from the KM-600™ is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%. Sizing takes place in a Mogensen Sizer with a top sieve of 1180–1900 micron spacing and a bottom sieve of 300–450 microns spacing.

The resulting granules have a bulk density of 450–550 g/l, a mean particle size of 600 microns, less than 3% of the granules are below 300 microns and less than 3% of the granules are above 1180 microns.

The resulting granules have a bulk density of 450–550 g/l, a mean particle size of 600 microns, less than 3% of the granules are below 300 microns and less than 3% of the granules are above 1180 microns.

Having thus described the invention in detail, it will be obvious to those skilled in the art that various changes may be made without departing from the scope of the invention and the invention is not to be considered limited to what is described in the specification.

What is claimed is:

1. A process for making a granular detergent composition, said process consisting essentially of the steps of mixing a surfactant paste together with spray dried granules, said granules comprising a member selected from the group consisting of anionic surfactants, nonionic surfactants, and mixtures thereof, and at least one member selected from the group consisting of dry agglomerates, wet agglomerates, and detergent adjunct ingredients in at least one moderate speed mixer having zones, the mean residence time of the moderate-speed mixer is from about 30 to about 1800 seconds, and adding crystalline sodium aluminosilicate to the last zone of said mixer to form particles, and conditioning said particles in at least one conditioning apparatus to provide particles having a bulk density in the range of 400 g/l to 650 g/l, said particles having a circularity less than about 30 and an aspect ratio less than about 2, wherein the granular detergent composition comprises at least about 50% by weight of the particles having a geometric mean particle diameter of from about 500 microns to about 1500 microns with a geometric standard deviation of from about 1 to about 2.

2. The process according to claim 1, wherein the conditioning apparatus includes at least one fluid bed granulator.

3. The process according to claim 1, wherein the mixer contains a ratio of dry agglomerates to spray dried granules from about 5:95 to about 95:5.

* * * * *

UNITED STATES PATENT AND TRADEMARK OFFICE

CERTIFICATE OF CORRECTION

PATENT NO. : 6,951,837 B1
APPLICATION NO. : 09/979531
DATED : October 4, 2005
INVENTOR(S) : Capeci et al.

It is certified that error appears in the above-identified patent and that said Letters Patent is hereby corrected as shown below:

Title Page item (75),

Inventors section, address for Scott William Capeci should read -- No. Bend, OH (US); --.

Between (*) Notice section and item (21) Appl. No. section, insert -- This patent is subject to a terminal disclaimer --.

Column 6

Line 31, delete “ml/s” and insert -- m/s --.

Line 59, delete “ml/s” and insert -- m/s --.

Column 7

Line 3, delete “ml/s” and insert -- m/s --.

Column 12

Line 17, delete “Harman” and insert -- Hartman --.

Line 21, delete “a” after incorporated.

Line 53, delete “µl” and insert -- g/l --.

Line 55, delete “KM-6001>” and insert -- KM-600™ --.

Column 14

Line 2, delete “80” and insert -- 1180 --.

Line 10 under Step 3, delete “µl” and insert -- g/l --.

Line 2 of Example 4, Step 1, delete “µl” and insert -- g/l --.

Line 4 of Example 4, Step 1, delete “µl” and insert -- g/l --.

UNITED STATES PATENT AND TRADEMARK OFFICE

CERTIFICATE OF CORRECTION

PATENT NO. : 6,951,837 B1
APPLICATION NO. : 09/979531
DATED : October 4, 2005
INVENTOR(S) : Capeci et al.

It is certified that error appears in the above-identified patent and that said Letters Patent is hereby corrected as shown below:

Column 15

Line 3 of Example 5, Step 1, insert -- ( -- (a parenthesis) after the word agglomerate.

Column 16

Line 10 of Example 5, Step 3, delete "g/," and insert -- g/l --.

Line 2 of Example 6, Step 1, delete "gA" and insert -- g/l --.

Signed and Sealed this

Twenty-ninth Day of April, 2008

JON W. DUDAS
*Director of the United States Patent and Trademark Office*